US005779503A

United States Patent [19]

Tremblay et al.

[11] Patent Number: 5,779,503

[45] Date of Patent: Jul. 14, 1998

[54] HIGH FREQUENCY CONNECTOR WITH NOISE CANCELLING CHARACTERISTICS

[75] Inventors: Edmond Tremblay, Saint-Blaise; Brenda Lord, Pointe-Claire; Yves Deflandre, Pierrefonds; Luc Milette, Montreal, all of Canada

[73] Assignee: Nordx/CDT, Inc., Canada

[21] Appl. No.: 769,711

[22] Filed: Dec. 18, 1996

[51] Int. Cl.[6] ..... H01R 23/02

[52] U.S. Cl. ..... 439/676; 439/941

[58] Field of Search ..... 439/344, 637, 439/676, 502, 941, 733.1, 709, 741

[56] References Cited

U.S. PATENT DOCUMENTS

| | | | |
|---|---|---|---|
| 5,186,647 | 2/1993 | Denkmann et al. | 439/395 |
| 5,310,363 | 5/1994 | Brownell et al. | 439/676 |
| 5,362,257 | 11/1994 | Neal et al. | 439/676 |
| 5,403,200 | 4/1995 | Chen | 439/676 X |

*Primary Examiner*—Khiem Nguyen
*Attorney, Agent, or Firm*—Wolf, Greenfield & Sacks, P.C.

[57] ABSTRACT

A high frequency electrical connector having a dielectric block onto which a terminal array of four pairs of electrical conductors are connected, the resulting assembly residing in a jack frame housing configured to removably receive a mating plug. The connector has a planar spring contact region for electrically contacting a corresponding planar contact region of the mating plug, a curved forefront region whereat non-electrical contact cross-overs of the terminal array conductors occurs, and a planar back region where reverse crosstalk is generated. The connector substantially compensates for crosstalk generated at the mating plug and connector contact regions. The configuration of the planar contact region of the mating plug and planar spring contact region of the connector is dictated by industry standards. To generate a sufficient reverse interference to cancel the crosstalk generated in these dimension-regulated parts, an "equivalent distance" of the planar back region sufficient to generate a reverse crosstalk that substantially eliminates the crosstalk generated in the contact regions of the mating plug and connector is provided. This equivalent distance is typically greater than the length of the planar spring contact region since the parallel mating plug conductors and their proximity to the spring contact region contribute to the crosstalk generated by the substantially parallel conductors of the terminal array in the spring contact region. To provide this equivalent distance, the non-contact cross-overs of the conductors are located immediately adjacent to the source of crosstalk without interfering with the industry standard dimensions.

15 Claims, 2 Drawing Sheets

HIGH FREQUENCY CONNECTOR WITH NOISE CANCELLING CHARACTERISTICS

BACKGROUND OF THE INVENTION

1. Field of The Invention

The present invention relates generally to electrical connectors and, more particularly, to high frequency electrical connectors having interference cancellation characteristics.

2. Related Art

The rate at which information is transferred between communicating devices has increased rapidly and substantially in recent years. At high data transfer rates, wiring paths become antennae that both broadcast and receive electromagnetic radiation. As a result, signal coupling, or crosstalk, occurs between adjacent wire-pairs. Crosstalk is generally defined as the unwanted transfer of energy from one wire-pair or channel (the disturbing wire-pair) to an adjacent wire-pair or channel (the disturbed wire-pair) causing an undesirable effect in the disturbed wire-pair. This undesirable effect is typically manifested as a decreased signal-to-noise ratio, degrading the ability of the communicating devices to process incoming signals. Accordingly, crosstalk has become an increasingly significant concern in electrical equipment design as the frequency of interfering signals is increased, particularly in the telecommunication industry where high speed transmissions are commonplace.

Crosstalk occurs not only in the cables that carry the data signals over long distances, but also in the connectors that are used to connect station hardware to the cables. Such cables are typically high performance unshielded twisted-pair (UTP) cables, the performance characteristics of which are dictated by EIA/TIA specification 568A, issued by the Telecommunications Industry Association (TIA) in cooperation with the Electronic Industries Association (EIA). To insure that the connecting component or hardware does not contribute significantly to crosstalk and is capable of supporting present and emerging applications having higher transmission rates, identified by ANSI/TIA/EIA standard 568A as Category 5 requirements has been developed.

Connectors, typically of the plug and jack receptacle type, are controlled by the FCC regulations (Subpart F of the FCC Part 68.500 Registration Rules) to insure compatibility between equipment from various manufacturers. The conductor pair assignments specified for such modular connectors in ANSI/TIA/EIA 568A standard are not optimum for meeting the Category 5 requirements of specific levels of crosstalk at specific frequencies. This is because such plugs and jacks include up to eight parallel wires that are positioned close together making them susceptible to excessive crosstalk.

Conventional approaches have been developed to address the excessive crosstalk experienced in these modular plugs and connectors when used to transfer high frequency signals. For example, U.S. Pat. No. 5,186,647 to Denkmann et al. discloses an electrical connector for conducting high frequency signals with reduced crosstalk between specific conductors in the connector. The lead frame of the connector is divided into three zones. Zone I is the forefront zone having a bent portion of the spring contacts. Zone II is the median zone at which the conductors are generally parallel and planar and where wire cross-overs occur to cause a reverse interference in the connector conductors. In Zone III a connection is made between the connector and a printed circuit board or cable conductors. Although this configuration provides some reduction in crosstalk and may achieve the noted objective of being simple to manufacture, the resulting connector insufficiently compensate for crosstalk, particularly at high frequency transmissions.

Another conventional approach similar to that of Denkmann is disclosed in U.S. Pat. No. 5,362,257 to Neal et al. Like Denkmann, the terminal array has a spring contact region, a bent portion and a rear planar portion where the non-contacting cross-overs of the parallel conductors occurs. The Neal connector is subject to the same drawbacks as those described above: it does not sufficiently compensate for crosstalk when transferring high frequency signals. In addition, the Neal connector has a complex cross-over scheme directed towards reducing crosstalk between specific wire-pairs, resulting in a non-standard pin assignment reducing its compatibility.

What is needed, therefore, is an electrical connector that does not contribute significantly to crosstalk, is compatible with the transmission characteristics of the cable or circuit to which it is connected, while supporting high speed data transfer rates.

SUMMARY OF THE INVENTION

The present invention is a high frequency electrical connector having a dielectric block onto which a terminal array of four pairs of electrical conductors are connected, the resulting assembly residing in a jack frame housing configured to removably receive a mating plug. The connector has a planar spring region for electrically contacting a corresponding planar contact region of the mating plug, a curved forefront region where a non-electrical contact cross-over of certain terminal array conductors occurs, and a planar back region where reverse crosstalk is generated. Significantly, the novel placement of the conductor cross-overs immediately adjacent to the connector's contact region enables the connector to substantially compensate for crosstalk generated between the conductors of the mating plug and connector contact regions. This enables the connector to achieve high frequency transmission performance not achievable by conventional modular connectors.

Generally, the configuration of the planar contact region of the mating plug and planar spring contact region of the connector is dictated by industry standards. To generate a sufficient reverse interference to cancel the crosstalk generated in these dimension-regulated parts, an "equivalent distance" of the planar back region is provided by the present invention. The equivalent distance is that length of substantially parallel wire-pairs in the planar back region sufficient to generate a reverse crosstalk that substantially eliminates the crosstalk generated in the contact regions of the mating plug and connector.

This equivalent distance is typically greater than the length of the connector contact region. This is because the parallel mating plug conductors as well as their proximity to the conductors of the connector contribute to the crosstalk generated by the parallel conductors in the connector's contact region. To provide an equivalent distance to optimize the minimizing effect of the reverse crosstalk generated after the wire cross-overs (to achieve the best interference cancellation), the novel connector of the present invention locates the non-contact cross-overs of the conductors immediately adjacent to the source of crosstalk without interfering with the industry-standard dimensions. That is, the cross-over region is positioned immediately adjacent to the connector contact region at the curved portion of the dielectric block. This minimizes the crosstalk generated, results in the immediate generation of reverse crosstalk, and also provides the ability to adjust the length of the conductors that generate reverse crosstalk to accommodate the different amounts of crosstalk generated at the contact regions when transferring signals having different characteristics. Thus, the connector of the present invention generates reverse crosstalk sufficient to cancel the above-noted crosstalk interference, resulting in the ability to transfer a high frequency signal relatively free of connector-induced interference.

Specifically, the reverse interference generated by the connector of the present invention is generated by a non-contact cross-over of the two conductors of a central and two outward pairs of conductors at the curved forefront region of the connector. The wire-pairs of the conductors are mounted in channels in the dielectric block which are generally parallel except at the curved forefront region where the channels cross direction to guide the wire cross-overs. In one embodiment, the conductors are frame wires stamped to fit the slots and are bent in place around the dielectric block to form the spring contact and planar back regions. The dielectric block and conductors are then fitted into an opening on one side of the jack housing to secure the conductors in place.

Further features and advantages of the present invention as well as the structure and operation of various embodiments of the present invention are described in detail below with reference to the accompanying drawings. In the drawings, like reference numbers indicate identical or functionally similar elements. Additionally, the left-most one or two digits of a reference number identifies the drawing in which the reference number first appears.

BRIEF DESCRIPTION OF THE DRAWINGS

This invention is pointed out with particularity in the appended claims. The above and further advantages of this invention may be better understood by referring to the following description taken in conjunction with the accompanying drawings, in which:

DETAILED DESCRIPTION OF THE PREFERRED EMBODIMENTS

Figure 1:
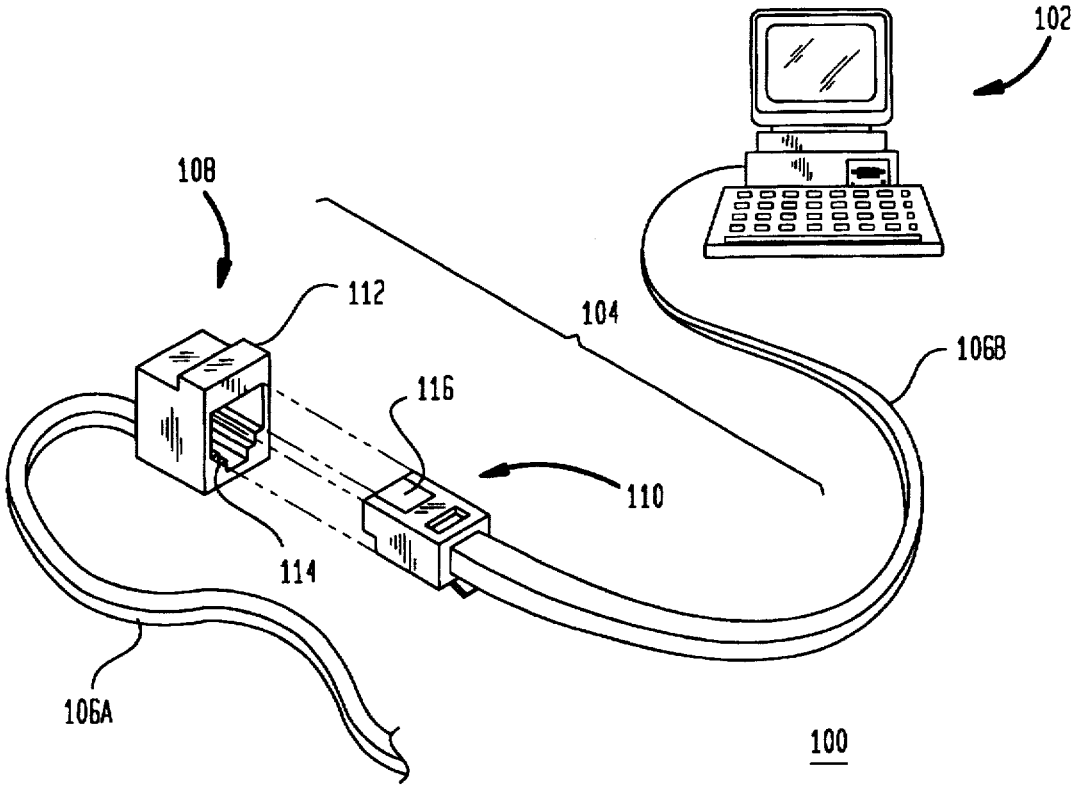
FIG. 1 is an exemplary application of the high frequency connector of the present invention connecting high speed station hardware with a communication cable.

A perspective view of a high speed data communications system utilizing the connector of the present invention is illustrated in FIG. 1. In the exemplary system 100, high speed station hardware 102 is electrically connected with a communicating device (not shown) via two or more cables 106A and 106B each of which comprises a number of wire-pairs. Electrical interconnection between the station hardware 102 and cables 106 is facilitated by the use of standard telecommunications connectors that are frequently referred to as modular plugs and jacks. Specifications for such plugs and jacks can be found in Subpart F of the FCC Part 68.500 Registration Rules. Connection assembly 104 is adapted to accommodate the use of modular plugs and jacks and comprises a connector 108 according to the present invention which is configured to receive modular plug 110.

Connector 108 includes a jack frame 112 with a front opening 114 configured to removably receive modular plug 110 which provides electrical signals via cable 106B to and from station hardware 102. Inserted into a rear side of jack frame 112 is an electrical connector terminal array (not shown in FIG. 1) configured in accordance with the principles of the present invention. The connector 108 provides electrical connections to the cable 106A, the wires of which are pressed into slots located on the rear of the connector 108 to make mechanical and electrical connections thereto. When the modular plug 110 is connected to the connector 108, a planar contact region 116 of the modular plug 110 contacts a corresponding planar contact region in connector 108 (not shown in FIG. 1) to achieve electrical and mechanic connections between cables 106A and 106B.

Terminal wiring assignments for modular plug 110 and connector 108 are specified in the Commercial Building Telecommunications Wiring Standard ANSI/TIA/EIA-568A. This standard associates individual wire-pairs with specific terminals for an 8-position, telecommunications outlet in the manner shown in FIG. 2. As shown, the conductors are numbered 1–8 from left to right as viewed from the front opening 114 to establish a numbering convention for the positioning of terminals in accordance with the ANSI/TIA/EIA-568A standard. The center two conductors, conductors 4 and 5, are a wire-pair and are assigned the label of Pair 1. The two left-most conductors, conductors 1 and 2, constitute a wire-pair and are assigned the label of Pair 3. The two right-most conductors, conductors 7 and 8, constitute a wire-pair and are assigned the label of Pair 4. The remaining two conductors, conductors 3 and 6, form a wire-pair and are given the label of Pair 2.

The Standard also prescribes the Near End Cross-Talk (NEXT) performance in the frequency range 1–16 MHz. As noted, the above wire-pair assignment causes considerable crosstalk to occur between the wire-pairs, particularly when high frequency signals are present. However, due to their widespread use and for reasons of economy, convenience and standardization, it is desirable to extend the utility of the above-mentioned communication plugs and jacks by using them at higher and higher data rates.

Although conventional connectors address the issue of crosstalk, they do not significantly or sufficiently reduce the crosstalk generated by the modular connectors when transferring high frequency signals. What the inventors have discovered is that the connector-related crosstalk primarily occurs between adjacent conductors in the contact region of the mating plug, between conductors in the contact region of the connector, and between the adjacent conductors in the mating plug and connector contact regions. The inventors realized that, because of these various significant crosstalk contributors, the crosstalk would not be completely eliminated by a reverse crosstalk region that was the same or shorter than the connector contact region as taught by the conventional connectors. By locating the wire cross-overs in a planar region some distance after the connector-related interference has been generated, conventional connectors provide little opportunity to generate an equivalent reverse interference. Thus, the inventors created the concept of an "equivalent distance," defined as that length of the conductors in the reverse crosstalk region that is needed to substantially eliminate the above-noted crosstalk generated at the contact regions.

In addition, it was also determined that the amount of crosstalk that occurred in the connector assembly 104 is a function of the frequency of the transferred signals. Thus, it was also desirable to provide a connector that had a reverse crosstalk region that may be configured to accommodate variations in the crosstalk generated by the connector assembly 108.

The inventors concluded that to optimize the minimizing effect of the reverse crosstalk generated after wire cross-overs (to achieve the best interference cancellation), as well as to provide the needed adjustability, the cross-over region must be positioned immediately adjacent to the source of the crosstalk. That is, the cross-over region must be positioned immediately adjacent to the connector contact region. Substantial benefits are achieved by this optimal placement of the wire cross-overs. First, these include the minimization of the crosstalk generated by eliminating any length of the conductors that generate crosstalk but are not required to satisfy industry standards. Second, reverse crosstalk is generated immediately after the contact region, providing a substantial region in which to create the necessary reverse crosstalk. Third, this also provides the ability to configure the length of the conductors in the reverse crosstalk region to accommodate the different amount of crosstalk generated by the transfer of signals having different characteristics.

Figure 3:
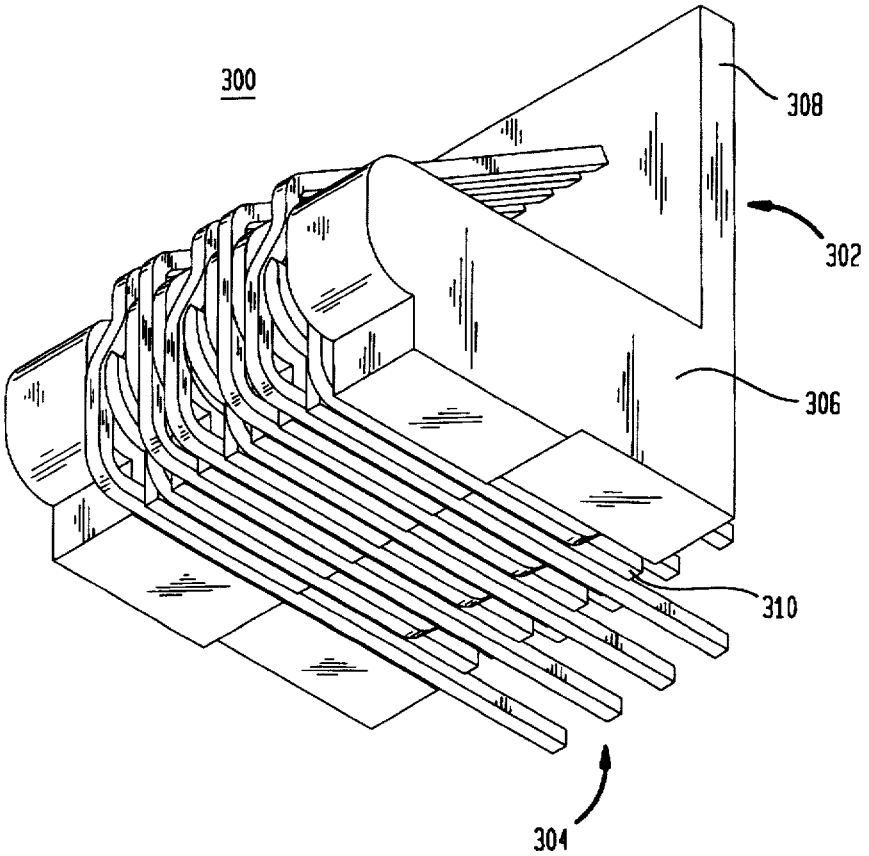
FIG. 3 is a perspective view of a preferred embodiment of the dielectric block and terminal array of the present invention.
Figure 4:
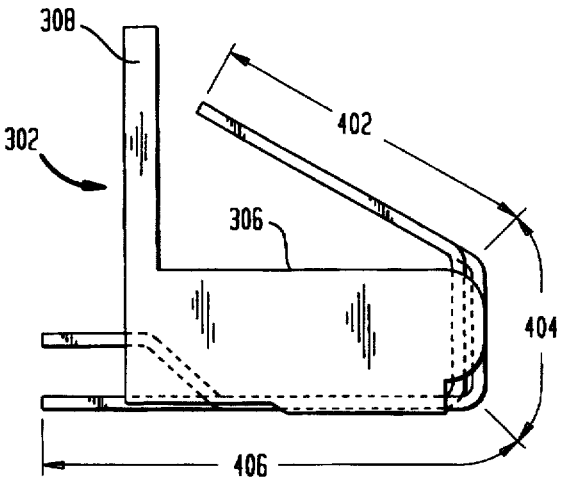
FIG. 4 is a side view of the dielectric block and terminal array of the present invention showing the three functional regions.
Figure 5:
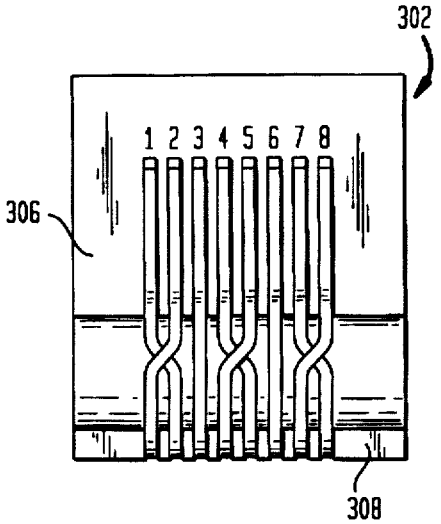
FIG. 5 is a front view of the dielectric block and terminal array of the present invention.

A perspective view of the terminal array and dielectric block configured in accordance with the present invention is illustrated in FIG. 3. FIGS. 4 and 5 show a side and front view, respectively, of the terminal array and dielectric block shown in FIG. 3. The dielectric block 302 is an L-shaped non-conducting structure having a spring block segment 306 configured to receive terminal array 304 and to be inserted into jack frame 112. A rear panel segment 308 of the spring block 302 is preferably integral with the spring block segment 306 and forms the rear surface of the connector 108 through which the cable 106A is electrically and mechanically connected to the connector 108.

Figure 2:
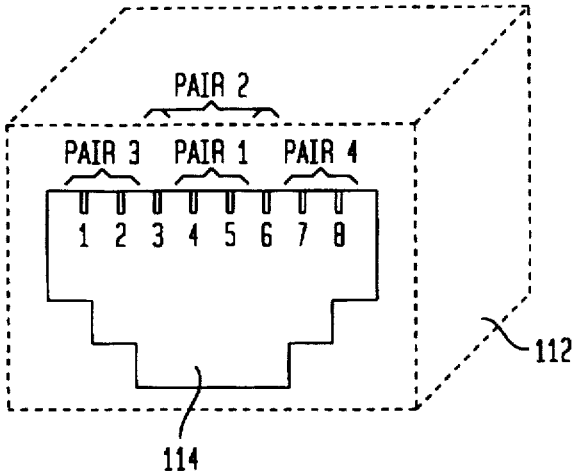
FIG. 2 is a perspective view of the jack frame housing showing wire assignments for an 8-position telecommunications outlet as viewed from the front opening.

Terminal array 304 preferably includes conductive elements 1–8 (numbered according to the FCC Standard and illustrated in FIG. 2). The terminal array 304 is functionally divided into three regions best illustrated in FIG. 4. A spring contact region 402 is a substantially planar region wherein the conductors 1–8 are essentially parallel with each other and extend away from the top surface of the spring block 306. Spring contact region 402 is configured to electrically contact the planar contact region 116 of mating plug 110 when mating plug 110 is inserted into the jack frame 112. Accordingly, the configuration and dimensions of the mating plug 110 and its contact region 116, as well as the spring contact region 402 of the connector 108, are dictated by the above-noted industry standards.

The terminal array 304 has a non-contacting cross-over region 404 immediately adjacent to the spring contact region 402. When assembled with the dielectric block 302, the cross-over region 404 is located at the curved portion of the spring block 306 in accordance with the present invention. The third functional region of the terminal array 304 is the planar back region 406 where the conductors are substantially parallel and in substantially the same plane. This region 406 produces sufficient reverse crosstalk to substantially eliminate the crosstalk generated between the conductors of the mating plug and connector contact regions. Thus, the contact region 402 is immediately adjacent to the cross-over region 404 which is immediately adjacent to the reverse crosstalk region 406, all three of which are electrically contiguous. This results in the generation of reverse crosstalk immediately after the interfering crosstalk is generated at the contact regions, thereby restricting the generation of crosstalk to only the contact regions and providing the maximum conductor length in the reverse crosstalk region. This provides the maximum possible reverse crosstalk and the greatest flexibility in adjusting the size of the reverse crosstalk region to accommodate different signal characteristics.

This novel arrangement results in a connector assembly 108 achieving a crosstalk between the more susceptible wire-pairs, Pair 1 and Pair 2, of at least 48.0 dB at 100 MHz. Table I shows exemplary performance results at 100 MHz between the various wire-pairs. As shown in Table I, significantly better performance results are achieved between the other wire-pairs which are not as sensitive to crosstalk as Pairs 1 and 2.

Exemplary Crosstalk Results at 100 MHz

| Disturbing/Disturbed Wire-Pair | Crosstalk (MHz) |
|---|---|
| Pair 1-2 | 48.3 |
| Pair 1-3 | 52.835 |
| Pair 1-4 | 49.565 |
| Pair 2-3 | 53.965 |
| Pair 2-4 | 49.088 |
| Pair 3-4 | 61.329 |

The spring block segment 306 of dielectric block 302 includes grooves or channels configured to securely receive the conductors of the terminal array. The dielectric block 302 maintains the position of the conductors of the terminal array such that they do not come into contact with each other and are configured in accordance with the above standard so that they can mate with the conductors of the mating plug 110.

Preferably, the terminal array 304 is a metallic lead frame wherein the conductors 1–8 are flat, elongated conductive elements stamped from, for example, 0.015 inch metal stock. Alternatively, the terminal array 304 may include wire conductors having substantially circular cross-sections. Because a portion of the terminal array 304 is used as a spring contact, the entire terminal array itself is preferably made from a resilient metal such as beryllium-copper although a variety of metal alloys can be used with similar results. It should be appreciated that the terminal array 304 contains 8 conductors to accommodate Subpart F of the FCC Part 68.500 Registration Rules. However, as one skilled in the relevant art would find apparent, the terminals array 304 may contain any number of conductors appropriate for a particular application.

At the cross-over region 404 certain of the channels 310 cross each other to achieve the preferred cross-over arrangement of the present invention. Although a number of techniques can be used to electrically isolate the conductors from each other in the cross-over region 404, the preferred embodiment achieves electrical isolation by introducing a re-entrant bend in the cross-over region 404. This is most clearly illustrated in FIG. 3 wherein conductors 2, 5 and 8 cross over conductors 1, 4 and 7, respectively, in wire-pairs 1, 3 and 4. Alternatively, the terminal array may be subjected to a well known insert molding operation or a dielectric spacer such as mylar may be inserted between the conductors 1–8. In the preferred embodiment, the spacing between the crossing conductors is 0.018 inches; however, other distances may be acceptable as well. At the rear planar or reverse crosstalk region 406, the dielectric block channels 310 are straight and substantially parallel so that the desired reverse crosstalk may be generated. The planar back region 406 also carries the electrical signals received by the spring contact region 402 through the rear panel segment 308 to the cable 106A.

During assembly, the terminal array 304 is bent around the spring block segment 306 of the dielectric block 302 to form the three functional regions described above. The conductors of the terminal array 304 are pressed into their respective channels or grooves. The jack frame housing 112 is then slid over the dielectric block 302 to secure the terminal array conductors in their respective channels and to create a unitary structure. Preferably, the jack frame 112 is removably secured to dielectric block 302 via integral pins on the block 302 and correspondingly-aligned holes in the jack frame 112. Alternatively, the terminal array 304 may be secured to the dielectric block 302 in any other well known manner, such as through the application of heat to the dielectric block causing it to slightly deform and permanently join with the terminal array 304.

In the preferred embodiment of the present invention, dielectric block 302 and jack frame 112 are made from any suitable thermal plastic material. However, as one skilled in the relevant art would find apparent, other materials having dielectric properties may be used. It should also be noted that the connector 108 may be mounted on a printed circuit board or alternatively, it may include IDC (insulation displacement clips) to be connected to a cable such as cable 106A. Other methods of electrically and mechanically connecting the connector 108 to a desired device or circuit may also be used.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. An electrical connector for electrically and mechanically mating with a mating plug, the connector comprising:

a dielectric block having an upper surface, a substantially parallel lower surface and a curved forefront section adjacent to said upper and lower surfaces; and a terminal array consisting of a plurality of conductors, including, a planar spring contact region configured to electrically connect with a corresponding contact region in the mating plug, a non-contacting cross-over region immediately adjacent to said contact region at said curved forefront section of said dielectric block, whereat specific pairs of said plurality of conductors have paths that cross, and a reverse interference region located at said lower surface of said dielectric block whereat said plurality of conductors are substantially parallel, wherein said dielectric block comprises a plurality of channels each configured to receive one of said plurality of conductors, said channels crossing at said curved forefront section of said dielectric block to create said non-contacting cross-over region of said terminal array.

2. The electrical connector of claim 1, further comprising:

a jack frame having front and back surfaces and a channel that extends therebetween creating a front opening in said front surface adapted to receive the mating plug and a rear opening in said rear surface adapted to receive said dielectric block such that the mating plug and said terminal array are electrically connected when the mating plug is inserted into said front opening.

3. The electrical connector of claim 2, wherein said jack frame secures said terminal array to said dielectric block.

4. The electrical connector of claim 1, wherein said terminal array conductors at said reverse interference region have an configurable length.

5. The electrical connector of claim 1, wherein said plurality of conductors comprises 8 conductors numbered in accordance with ANSI/TIA/EIA-568A, and wherein said specific wire-pairs are wire-pairs 2, 3 and 4.

6. A terminal array having a plurality of conductors for use for use with a terminal block in an electrical connector that electrically mates with a mating plug, the terminal block comprising a plurality of channels each configured to receive one of said plurality of conductors, said channels; crossing at a curved forefront section of the terminal block, the terminal array comprising:

a contact region configured to electrically connect with a corresponding contact region in the mating plug;

a non-contacting cross-over region constructed and arranged to be located the curved portion of the terminal block whereat specific wire-pairs are crossed; and a reverse Interference region whereat a reverse crosstalk is generated in said crossed wire pairs sufficient to eliminate crosstalk generated at said contact region and said corresponding contact region.

7. The terminal array of claim 6, wherein said plurality of conductors in said contact region are substantially planar and parallel.

8. The terminal array of claim 6, wherein said contact region of the terminal array and said corresponding contact region of the mating plug having dimensions that are in compliance with industry standards.

9. The terminal array of claim 6, wherein the terminal array comprises four wire-pairs of two conductors each, including a first wire pair comprising first and second conductors, a second wire pair comprising third and fourth conductors, a third wire pair comprising fifth and sixth conductors and a fourth wire pair comprising seventh and eighth conductors.

10. The terminal array of claim 9, and wherein said fifth, first and seventh conductors cross over said sixth, second and eighth conductors, respectively, at said non-contacting cross-over region.

11. An electrical connector for electrically mating with a mating plug, comprising:

a dielectric block having a first surface, a forefront section immediately adjacent to said first surface, and a second surface substantially parallel with said first surface and adjacent to said forefront section, comprising a plurality of channels crossing at said forefront section; and a terminal array of four pairs of substantially parallel conductors adapted to be positioned within said forefront section, including, a substantially planar spring contact region whereat said conductors are substantially parallel and are bent away from said first surface of said dielectric block, said spring contact region configured to electrically connect with a corresponding contact region in a mating plug, a non-contacting cross-over region at said forefront section of the dielectric block, wherein specific wire-pairs include wires positioned in said channels that cross each other, and a reverse interference region having substantially parallel and planar conductors secured to said second surface of said dielectric block.

12. The terminal array of claim 11, wherein said contact region of the terminal array and said corresponding contact region of the mating plug having dimensions in compliance with industry standards.

13. The terminal array of claim 11, wherein the terminal array comprises four wire-pairs of two conductors each, including a first wire pair comprising first and second conductors, a second wire pair comprising third and fourth conductors, a third wire pair comprising fifth and sixth conductors and a fourth wire pair comprising seventh and eighth conductors.

14. The terminal array of claim 13, and wherein said fifth, first and seventh conductors cross over said sixth, second and eighth conductors, respectively, at said non-contacting cross-over region.

15. The terminal array of claim 13, wherein said specific crossing wire-pairs include wires that have a re-entrant bend to electrically isolate said crossing conductors from each other in said cross-over region.

* * * * *